US006044973A

United States Patent [19]

Vasudeva

[11] Patent Number: 6,044,973

[45] Date of Patent: Apr. 4, 2000

[54] CASE WITH SPLIT PANELS

[75] Inventor: Kailash C. Vasudeva, Waterloo, Canada

[73] Assignee: Maxtech, Inc., Roseville, Mich.

[21] Appl. No.: 09/244,509

[22] Filed: Feb. 4, 1999

Related U.S. Application Data

[63] Continuation-in-part of application No. 09/040,433, Mar. 18, 1998, abandoned, and application No. 08/864,340, May 28, 1997, abandoned.

[51] Int. Cl.[7] ..... B65D 85/00

[52] U.S. Cl. ..... 206/372; 206/373

[58] Field of Search ..... 206/372, 373, 206/376, 377, 378, 379

[56] References Cited

U.S. PATENT DOCUMENTS 4,340,140 7/1982 Wilcox et al. ..... 206/373
5,398,810 3/1995 Yao Wang ..... 206/373
5,526,929 6/1996 Wei ..... 206/372

*Primary Examiner*—Jacob K. Ackun
*Attorney, Agent, or Firm*—R. Craig Armstrong

[57] ABSTRACT

The case has a box portion and a lid, with panel sections cooperatively configured to fit across the box portion, the panel sections being configured to accommodate articles such as tools and/or tool components, hobby items, craft kits, toys, etc. The panel sections may or may not be secured to each other, and may or may not be on the same level relative to each other. There may be two such panel sections, or a number of panel sections. The panel sections may include an opening to accommodate a storage compartment which projects upwardly from the bottom of the case and is accessible from the bottom of the case. In one embodiment, a lower one of the panel sections has above it at least one smaller panel section which is slidably mounted relative thereto.

20 Claims, 17 Drawing Sheets

CASE WITH SPLIT PANELS

REFERENCE TO RELATED APPLICATION

This is a continuation-in-part of application Ser. No. 09/040,433, filed Mar. 18, 1998, and is a continuation-in-part of application Ser. No. 08/864,340, filed May 28, 1997, now both abandoned.

BACKGROUND OF THE INVENTION

This invention relates to a case for storing articles, particularly of the type used to display a tool set at the point of sale, and to subsequently store the tool set. Such tool cases are commonly referred to as "gift cases".

For convenience, reference will be made to tools, tool components and tool cases throughout this specification. However, it should be clearly understood that the case could be used for other small articles such as hobby kits, craft kits, toys, etc. Use of the word "tools" is thus for convenience and is not intended to be limiting.

Cases of the general type are well known, and typically include a base in the form of an open-topped box, and a lid hinged or otherwise mated with the box portion, with a clip or other means to retain the lid in the closed position. For convenience, these main components will hereinafter be referred to as the base and the lid. The case typically provides recesses to accommodate various tools and components, such as, for example, a screwdriver and various bits therefor, these recesses typically being provided in a panel positioned across the top of the base. The lid frequently has a transparent face, or may be entirely transparent, so that the tools can be seen when the case is closed.

At present, the tendency is to use a unique case for each tool set. However, this results in incurring the costs of a new mold whenever a new tool set is produced for the market. There is a need for a more universal tool case, which can accommodate many different tool set configurations, to reduce these mold costs and to provide greater flexibility in general.

One solution to this problem has been to mold one tool case with a lid and an open base which can be fitted with a panel to hold different tools and components, such as screwdriver bits and sockets. Therefore, the tool case can be made from the same mold and adapted to hold various tools by fitting the tool case with a different panel.

However, this solution does not offer sufficient flexibility. In a larger version of a tool case, it is often desirable to have the ability to not only exchange an entire panel (i.e. entire contents of a tool case), but also exchange only a section of a panel. This is particularly advantageous in a larger tool case because of the larger surface available. In this way, one panel section could accommodate, for example, a screwdriver and a complete set of bits or a ratchet and a complete set of sockets, while several other panel sections could be manufactured to provide various options for the rest of the tool case.

SUMMARY OF THE INVENTION

In view of the above, it is an object of the invention to provide an improved tool case, which provides greater flexibility in the tools which it may be adapted to hold at the point of sale.

Thus in the invention, the tool case is adapted to receive one or more panel sections. These sections may or may not be secured to each other, and may or may not be removable.

In embodiments where the panel sections are secured to each other, this may be accomplished by any suitable means, such as by inserting a male dovetail tab molded to at least one side of a first panel section onto a corresponding female dovetail recess defined within an adjacent side of a second panel section.

Preferably, the panel sections are positioned on the box portion by inserting guide posts protruding from the bottom of the panel sections into corresponding openings protruding upwardly from the box portion, although clearly, many alternative positioning and securing means could be used.

The panel sections may all be in the same plane, or may be "stepped" or even stacked, as will be described in greater detail below.

BRIEF DESCRIPTION OF THE DRAWINGS

The invention will now be described in detail with reference to the accompanying drawings of a tool case, for example, in which.

DETAILED DESCRIPTION OF THE PREFERRED EMBODIMENTS

Figure 1:
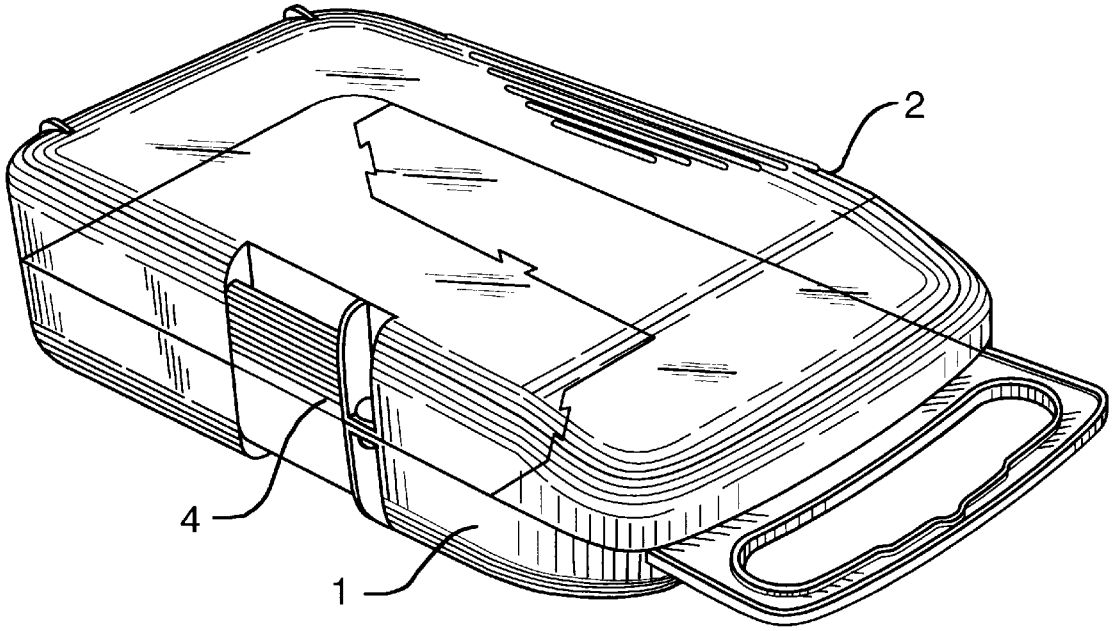
FIG. 1 is a perspective view from above and to one side of the tool case (with recesses molded in the panel sections to retain tools and components not being shown)
Figure 2:
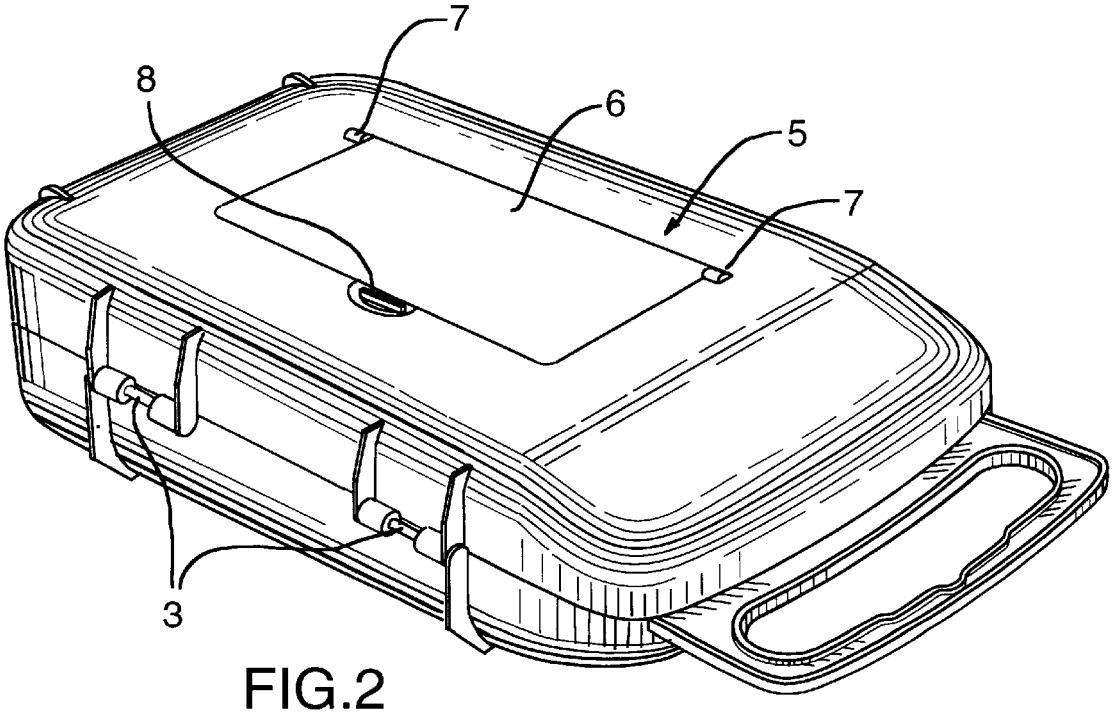
FIG. 2 is a perspective view from below and to one side of the tool case.

Referring to the drawings, FIGS. 1 and 2 show the case, which in this case is a tool case. The tool case includes a preferably plastic box portion 1 and a preferably transparent lid 2 hinged to the box portion, for example, by two hinges 3. A plastic clip 4 secures the lid to the box portion in a conventional fashion, although any other suitable means to secure the lid could be used.

Figure 7:
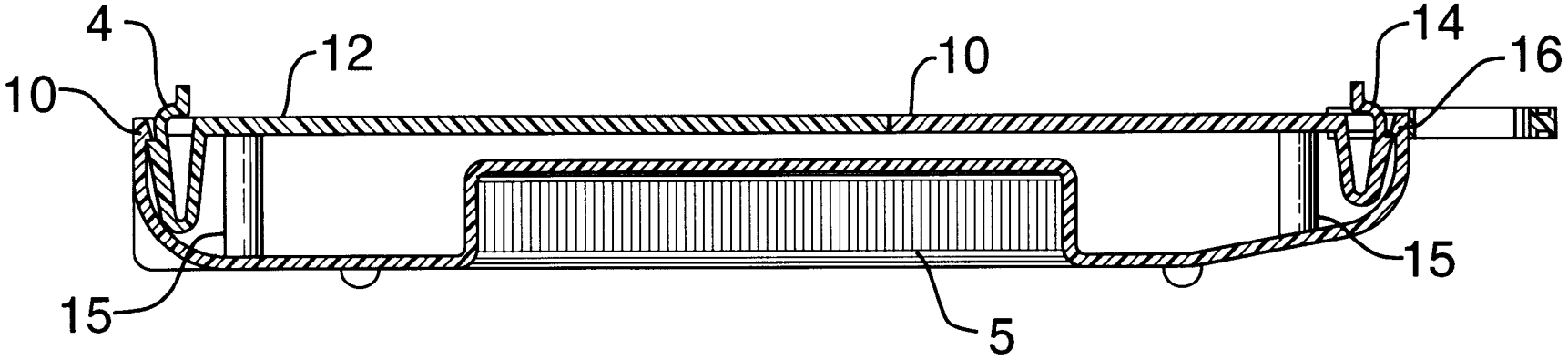
FIG. 7 is a cross-sectional view of the tool case along line B—B.

FIGS. 2 and 7 show a generally rectangular molded storage compartment 5 defined within the bottom surface of the box portion. The storage compartment is accessed via a door 6 hinged to the box portion at one end by two hinges 7 and secured to the box portion at the other end by a conventional clasp 8.

Figure 3:
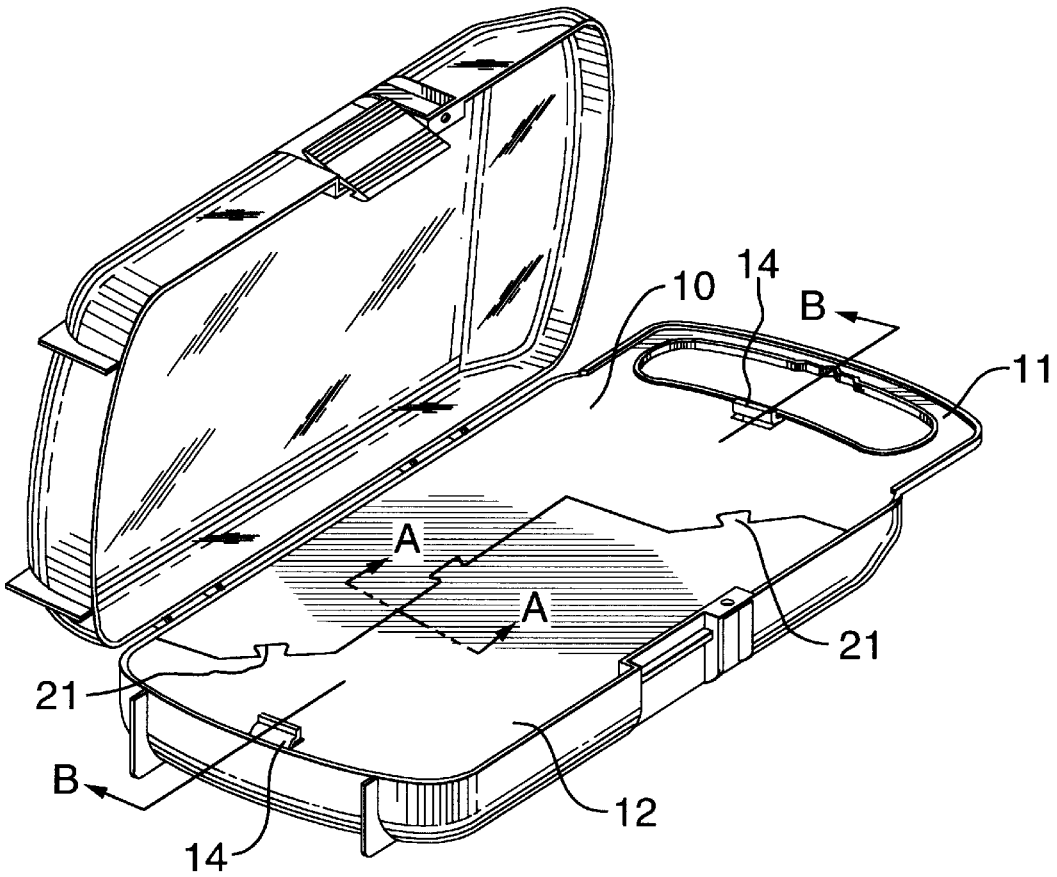
FIG. 3 is a perspective view looking down on the top of the tool case with the lid open (again with recesses molded in the panel sections to retain tools and components not being shown)

FIG. 3 shows the preferred embodiment of the invention where two plastic panel sections are secured within the box portion. A first panel section 12 is located toward the right side of the box portion and a second panel section 10 with a molded handle 11 extending therefrom is located toward the left side of the box portion. A number of shapes are molded within the panel sections to accommodate a specific tool or a component, such as a screwdriver bit or a socket. In the interest of clarity, the shapes molded in the panels are not shown in some of the accompanying drawings.

Obviously, the handle 11 does not have to extend from one of the panel sections, but could extend from the body of the case, i.e. from the box portion 1. Alternatively, there could be no handle at all.

Figure 4:
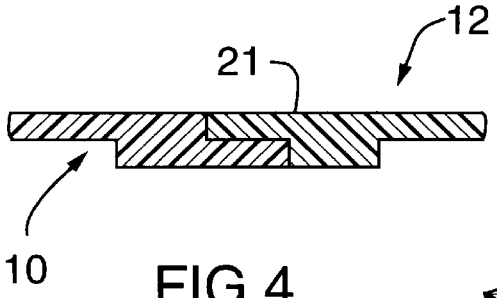
FIG. 4 is a cross-sectional view along line A—A.
Figure 5:
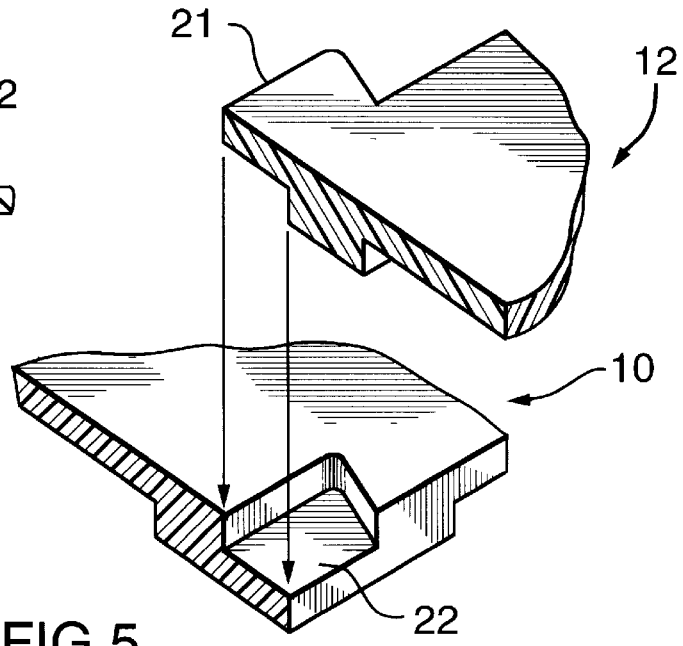
FIG. 5 is an exploded cut away view detailing means of securing of one panel section to another.

FIGS. 3 to 5 show that the panel sections may be secured to each other by inserting a male dovetail tab 21 projecting from preferably each edge of the first panel section 12 into a corresponding female dovetail recess 22 defined within each edge of the second panel section 10. However, any other suitable means of securing the panel sections to each other may be used, or the panels may not be secured to each other at all. When the two panel sections are joined to each other in the manner described herein, they in effect may form a single panel covering the open top of the box portion 1.

Figure 6:
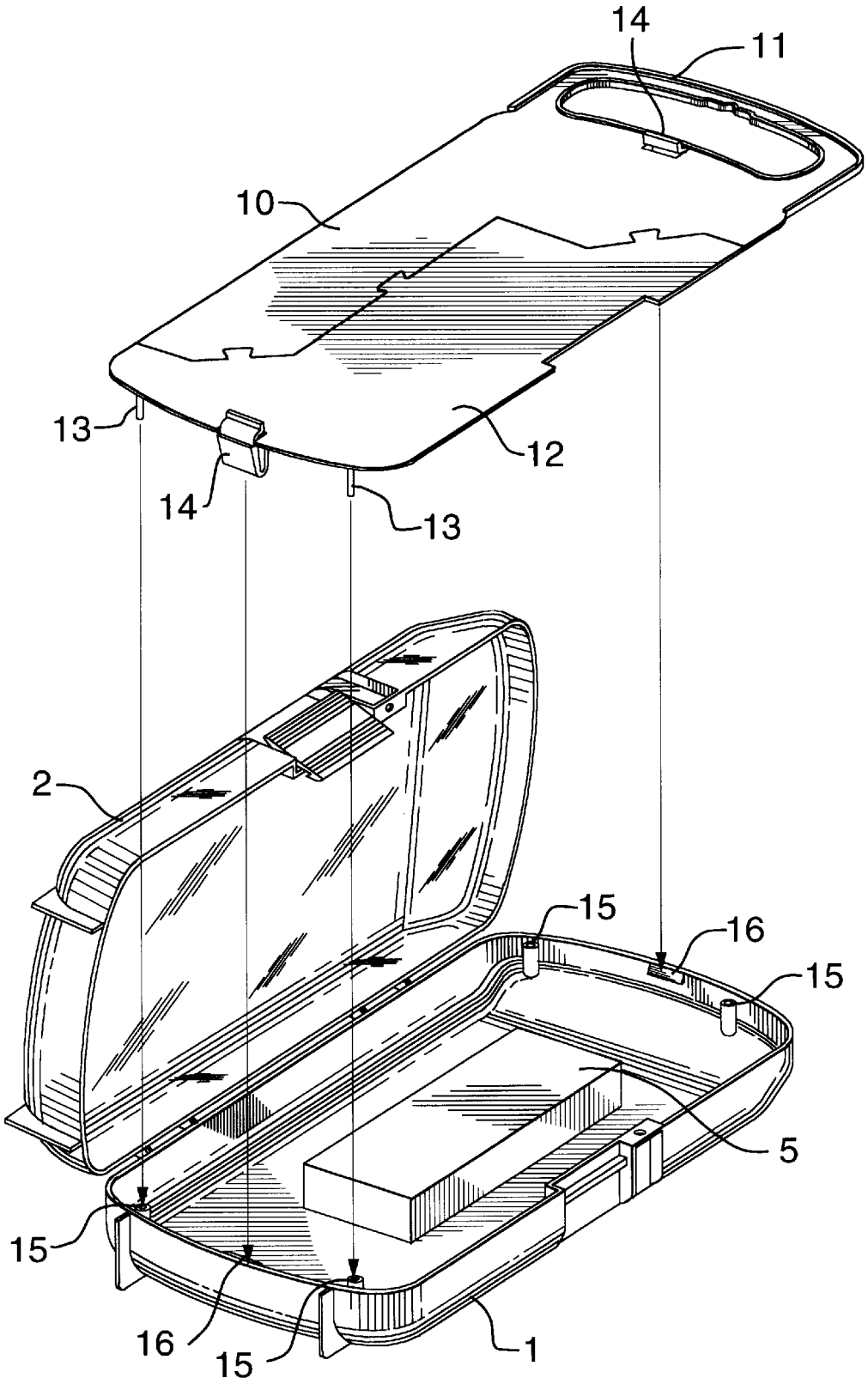
FIG. 6 is an exploded view of the tool case (again with recesses molded in the panel sections to retain tools and components not being shown)
Figure 28:
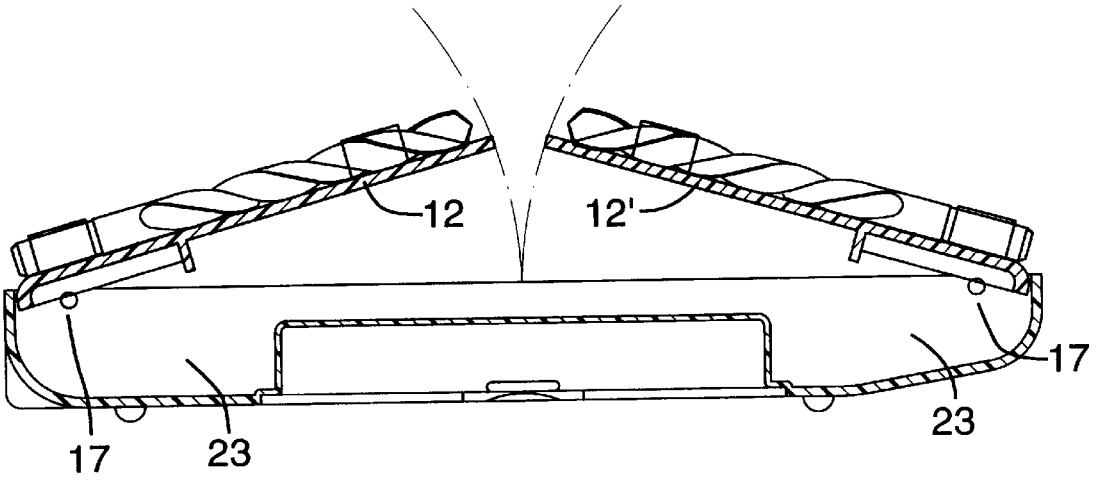
FIG. 28 is an elevation view showing two cooperative panels which are hinged to the box portion of the case.
Figure 29:
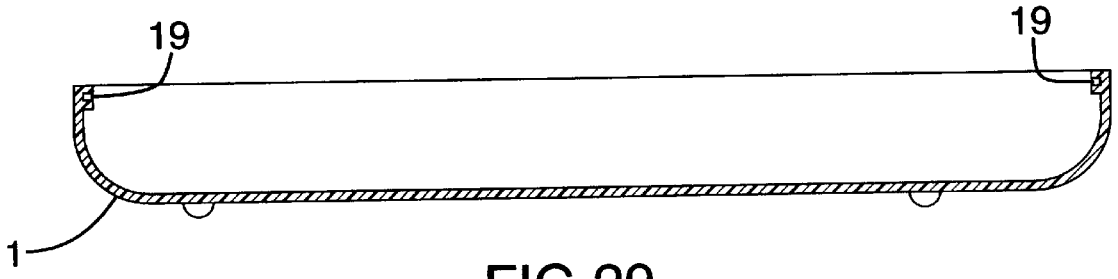
FIG. 29 is a cross-section of the box portion of the case, showing grooves to accept a slide-in panel.

The panel sections are mounted to the box portion by any suitable means, such as shown in FIGS. 6 and 7, where posts 13 protruding from the bottom surface of the panel sections are inserted into corresponding female openings 15 projecting upwardly from the bottom of the box portion 1. Clearly, a wide variety of alternative embodiments varying the locations of the posts and the female openings will be apparent to those skilled in the art, and such alternatives are within the scope of this invention. The panel sections are secured to the box portion by, for example, two conventional plastic catches 14 projecting downwardly from the edge of the first panel section 12 and the edge of the second panel section 10 facing the front and rear ends of the box portion, respectively. As the panel sections are inserted into the box portion the catches snap onto corresponding molded ridges 16 projecting outwardly from the front and rear ends of the box portion, securing the panel sections within the box portion. However, any other suitable method of securing the panel sections, such as tabs, adhesives, hinges 17 (as shown in FIG. 28) or ultrasonic welding may be used and is within the scope of this invention. FIG. 29, for example, shows grooves 19 in the wall of the box portion 1, to receive a slide-in panel.

The securing of the panel sections could be of a permanent nature, as with ultrasonic welding, or it could be temporary, i.e. the panel sections could be removable. Another alternative is as shown in FIG. 28, where the panel sections 12 and 12' are "permanently" secured, but via hinges which provide access to storage space 23 provided beneath the panels in the box portion. This additional storage space could be provided with divider walls if desired, for more efficient storage of small items.

Figure 9:
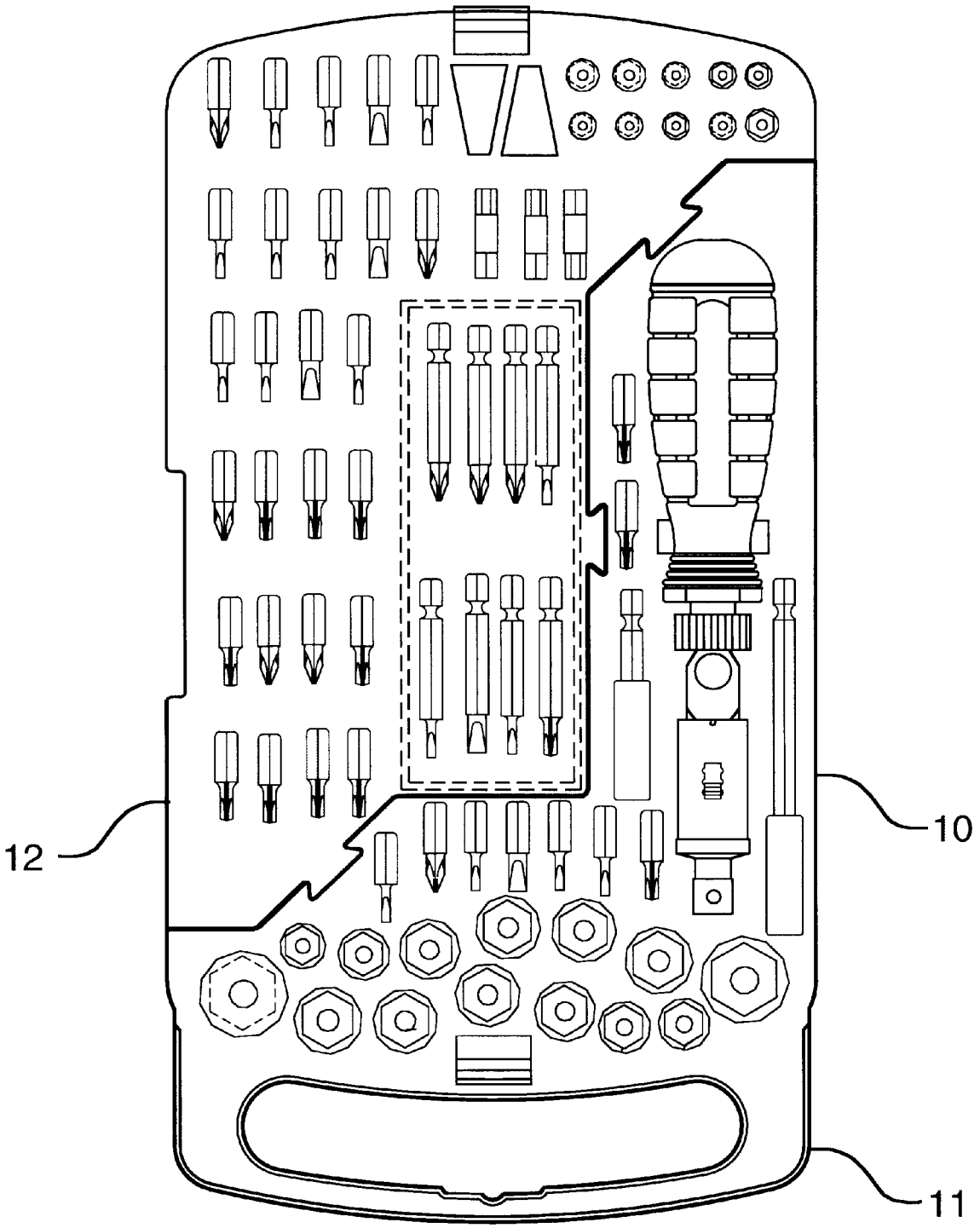
FIG. 9 is a plan view of an alternative embodiment of the invention detailing alternative tools to be retained within the panel sections.
Figure 10:
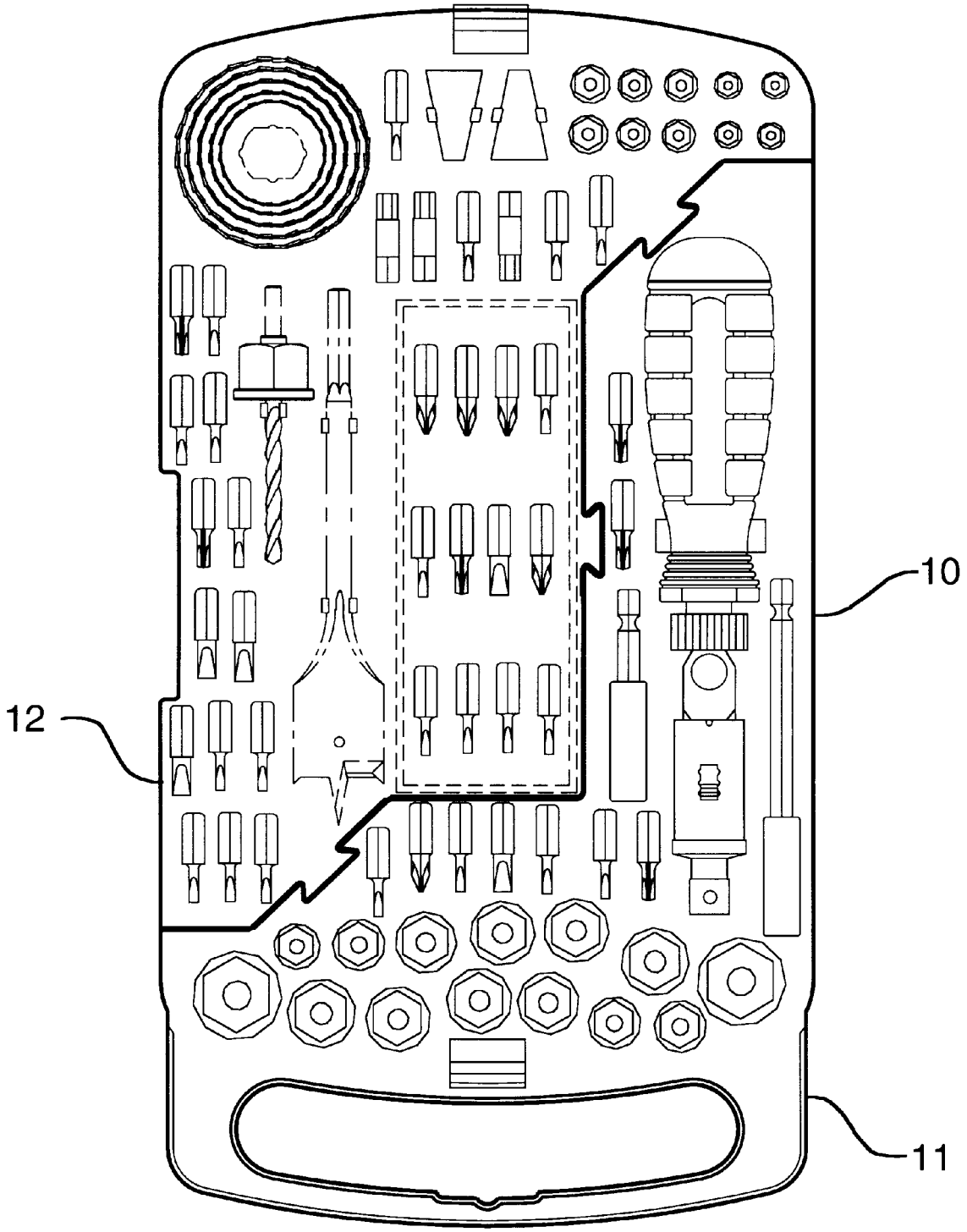
FIG. 10 is a plan view of another alternative embodiment of the invention detailing other alternative tools to be retained within the panel sections.
Figure 11:
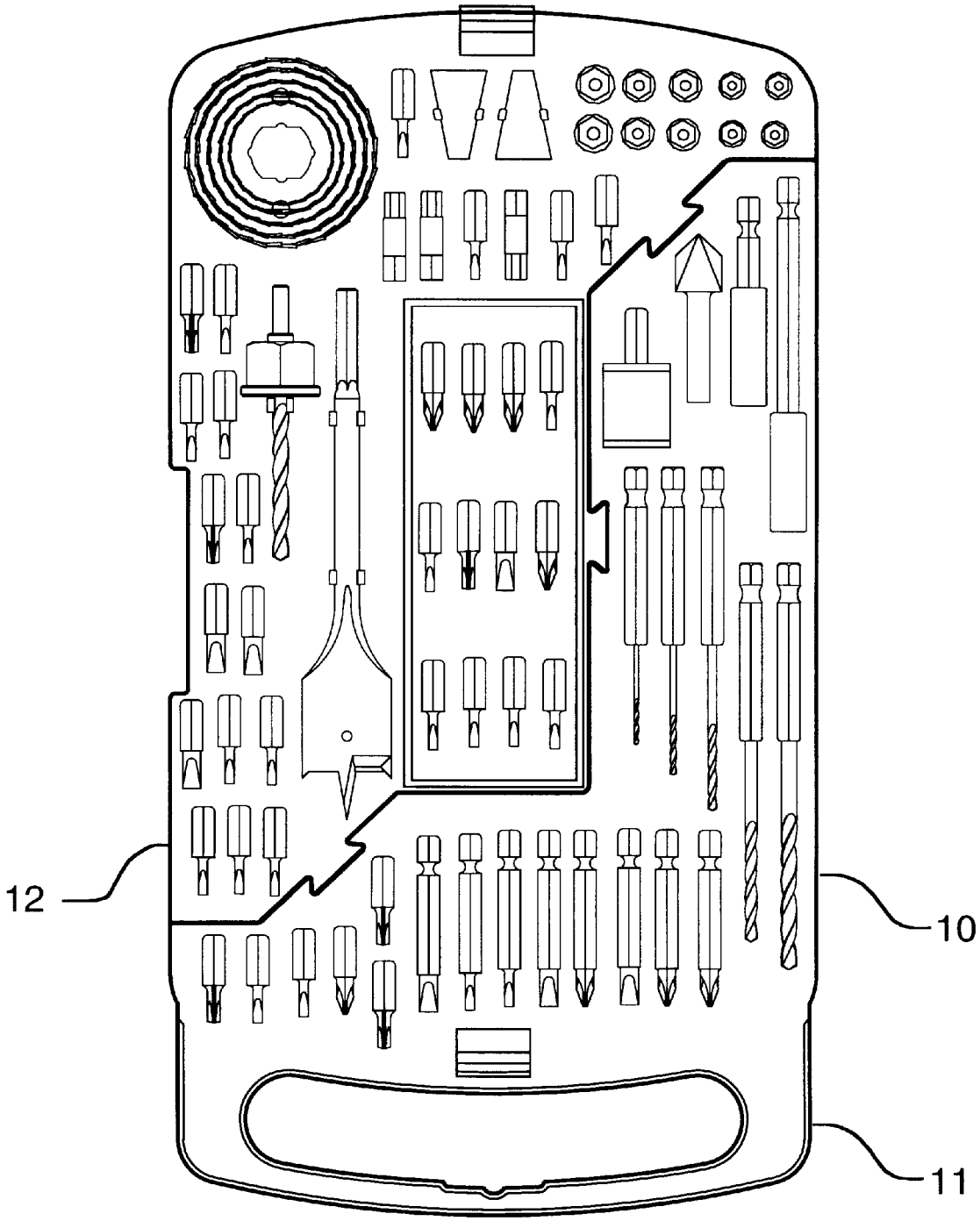
FIG. 11 is a plan view of yet another alternative embodiment of the invention detailing yet other alternative tools to be retained within the panel sections.

FIGS. 9 to 11 show three alternative configurations of the panel sections, to retain different types of tools and components. However, it should be clear that a wide variety of other embodiments could be used, to accommodate myriad tool types and related components. To accommodate these various combinations of tools and components, the number and shape of the panel sections can likewise be varied. The available surface area may be subdivided diagonally, linearly, or by a combination thereof to yield two, three, four, or more panel sections. If desired, each panel section may be color-coded to represent various quality levels, configurations, sizes and types of tool or components (metric vs. English units, for example).

There are also many possible variations on the size and shape of the panel sections, as well as the methods of securing them to each other (if any), all of which are contemplated as being within the scope of the invention.

Figure 8:
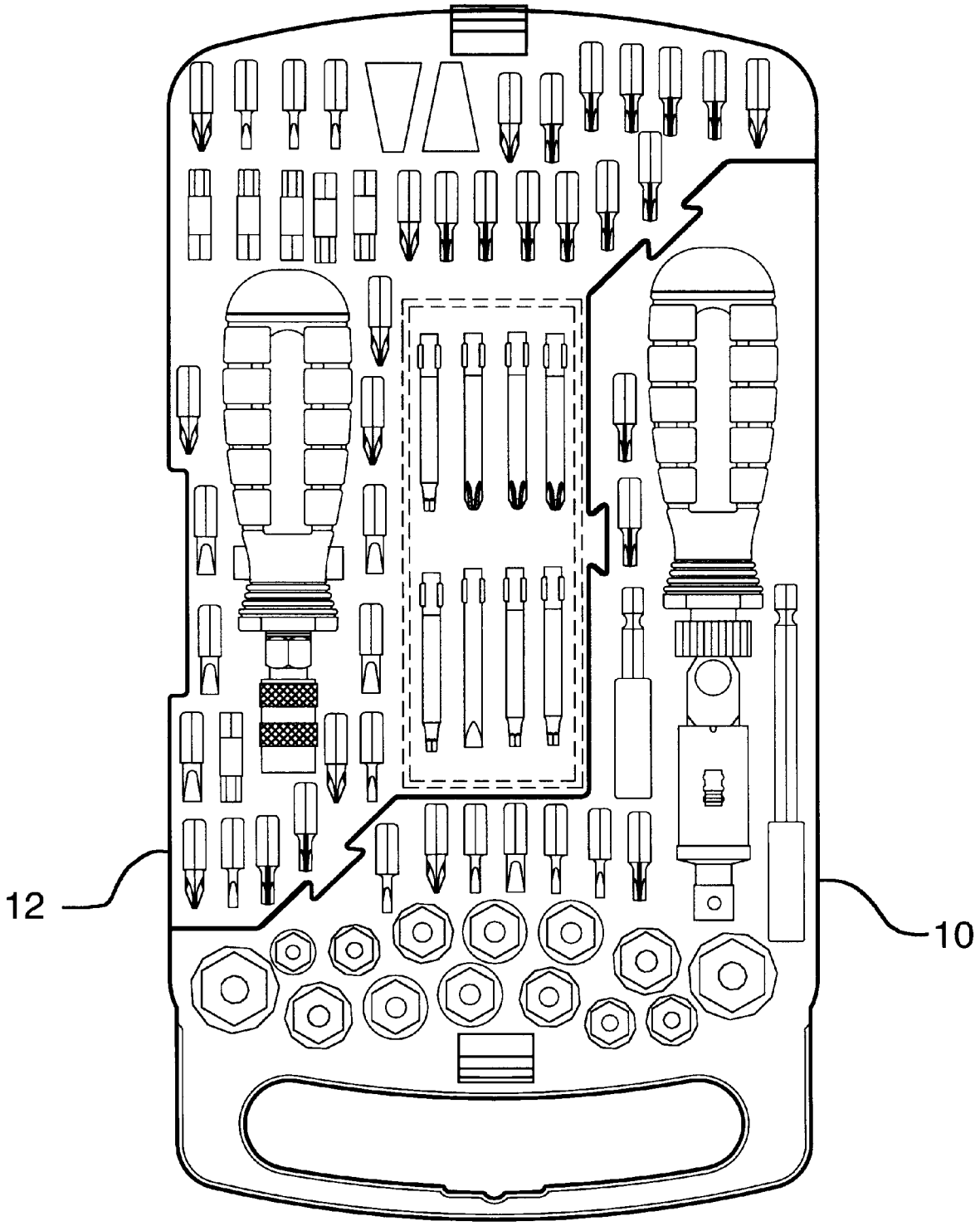
FIG. 8 is a plan view of the preferred embodiment of the invention detailing the tools to be retained within the panel sections.
Figure 12:
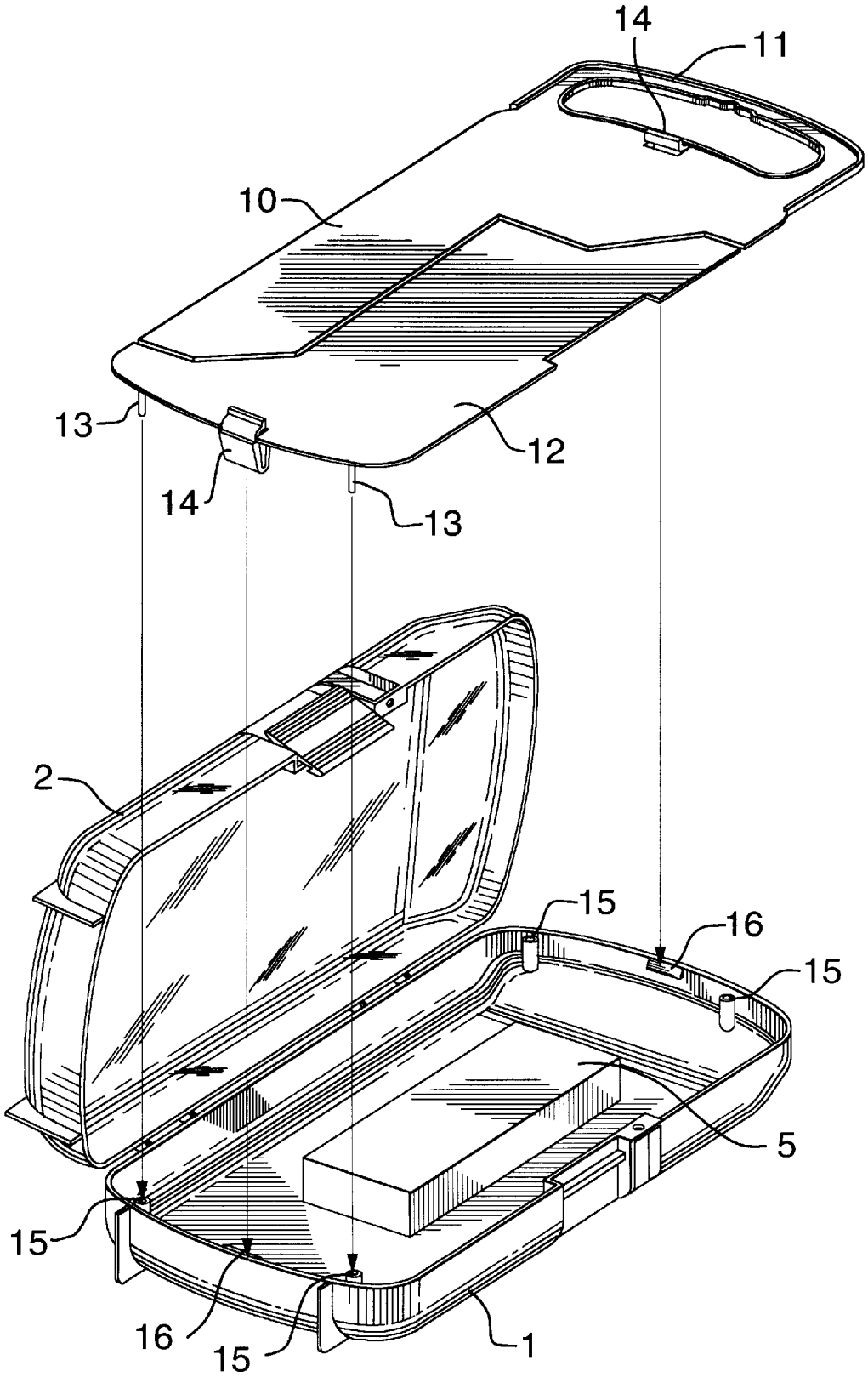
FIG. 12 is an exploded perspective view of an embodiment where the panel sections are not connected to each other, but are cooperatively shaped to form the shape of a single larger panel.
Figure 13:
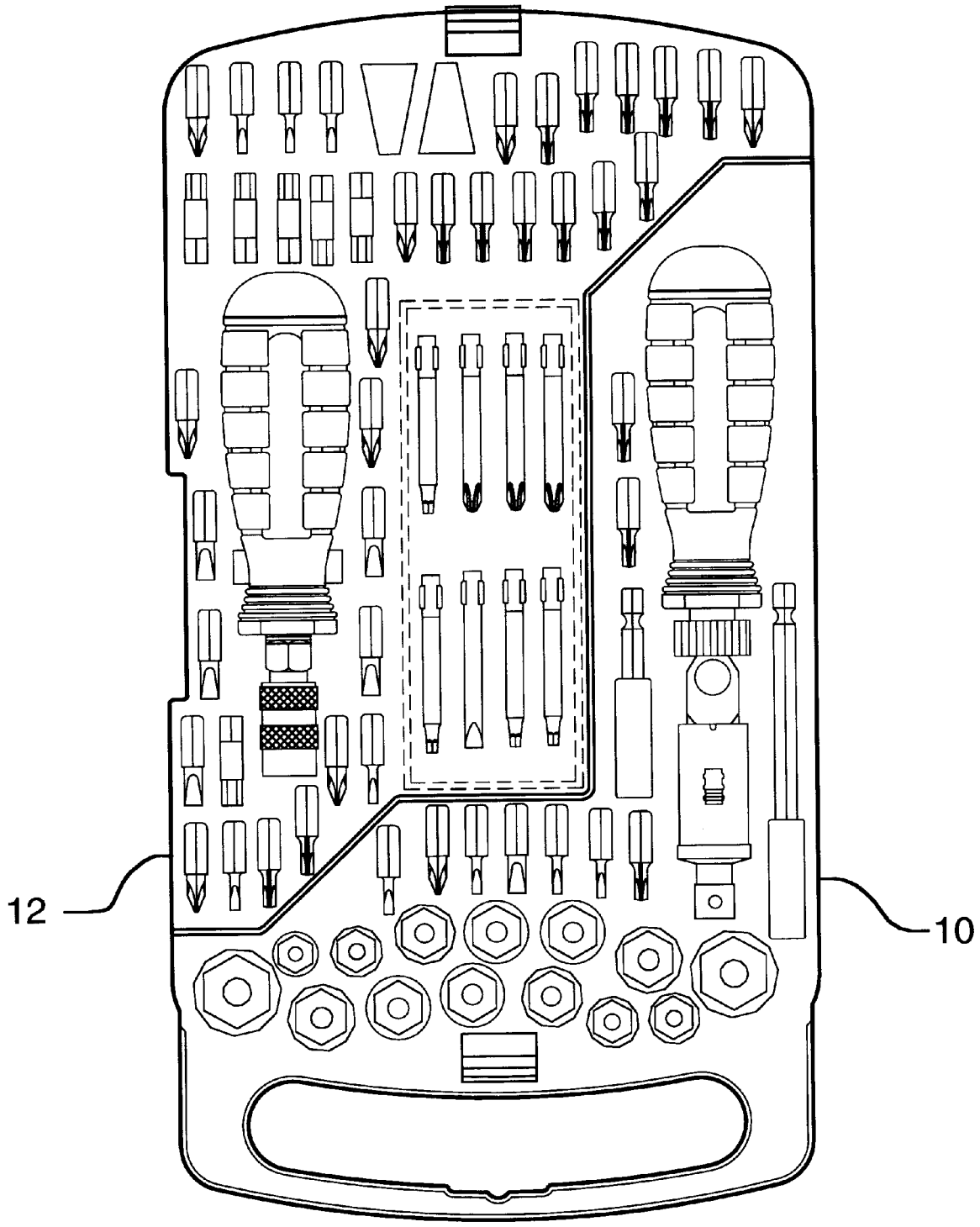
FIG. 13 is a plan view of the panel sections of FIG. 12, showing a typical tool layout.

For example, FIG. 12 is an exploded perspective view of an embodiment where the panel sections are not connected to each other, but are cooperatively shaped to form the shape of a single larger panel, FIG. 13 is a plan view of the panel sections of FIG. 12, showing a typical tool layout, as in FIG. 8.

Figure 14:
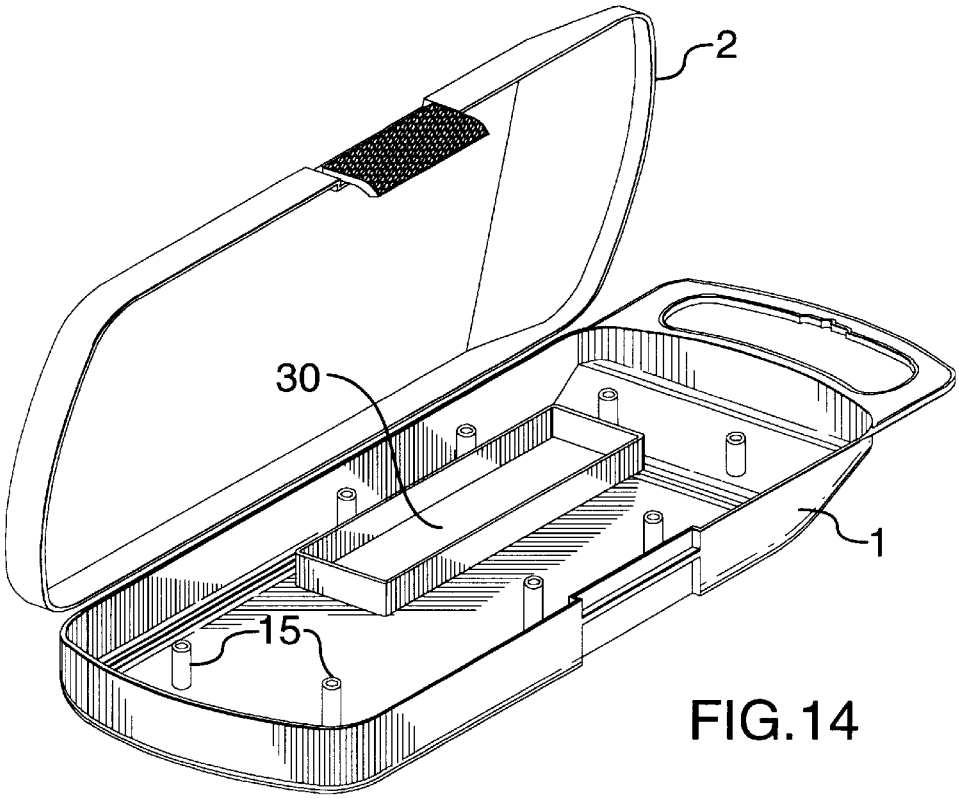
FIG. 14 is a perspective view of an alternative base, with an open bottom portion to receive a snap-in secondary storage means.

FIG. 14 is a perspective view of an alternative base, with an open bottom portion 30 to receive a snap-in secondary storage means (such as a snap-in drawer unit, for example, accessible from underneath the case).

Figure 15:
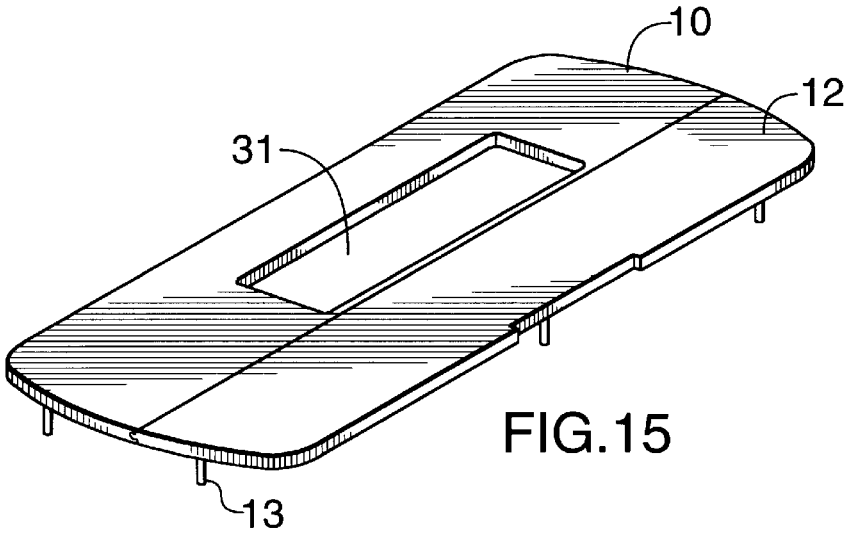
FIG. 15 is a perspective view of two panel sections which fit within the FIG. 14 base.

FIG. 15 is a perspective view of two panel sections which fit within the FIG. 14 base, one of the panel sections including an optional opening 31 for the snap-in secondary storage means to extend through, if desired, to provide such secondary storage means with greater depth.

Figure 16:
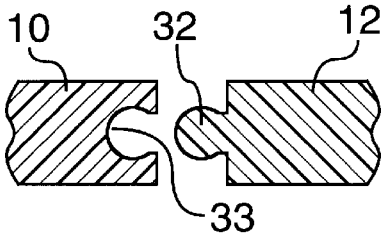
FIG. 16 is a cross-section of FIG. 15.

FIG. 16 is a cross-section of FIG. 15, showing a tongue 32 and groove 33 connection between the two panels, although it should be clear that the panels are not necessarily connected to each other.

Figure 17:
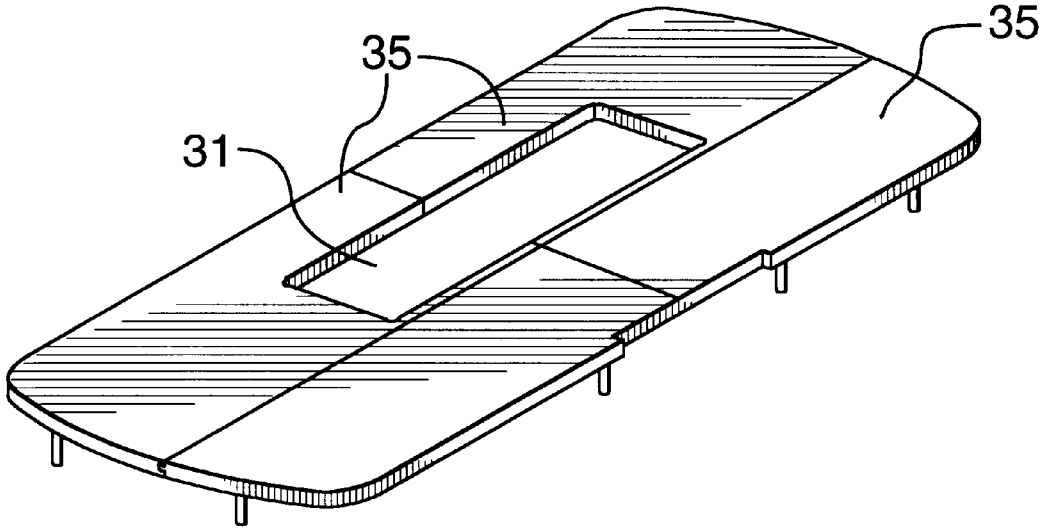
FIGS. 17 and 18 are perspective views of four and six panel sections respectively, which fit within the FIG. 14 base.
Figure 18:
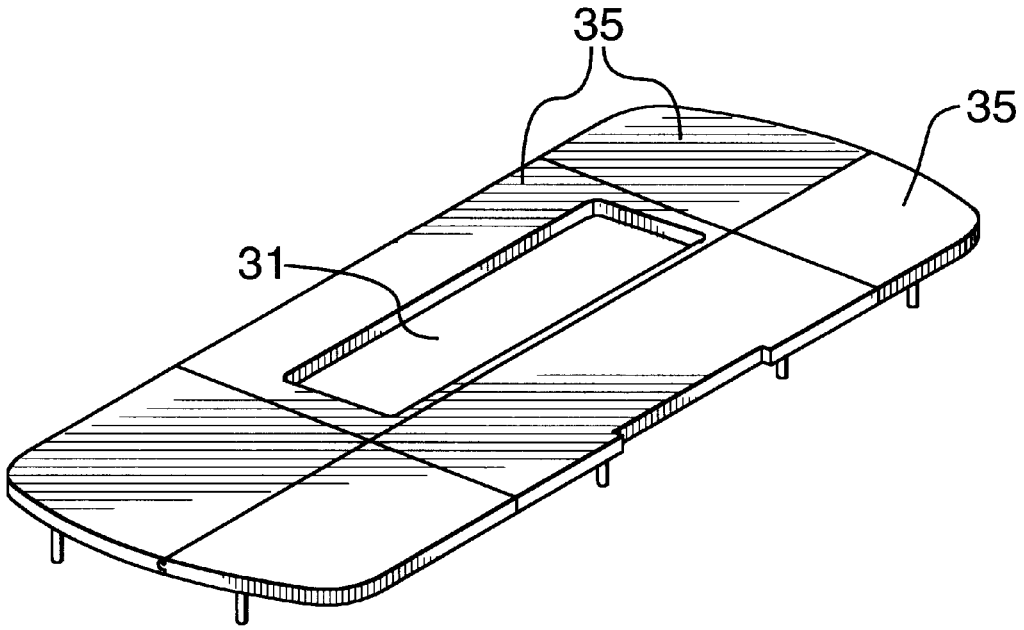

FIGS. 17 and 18 are perspective views of four and six panel sections 35 respectively, which fit within the FIG. 14 base.

Figure 19:
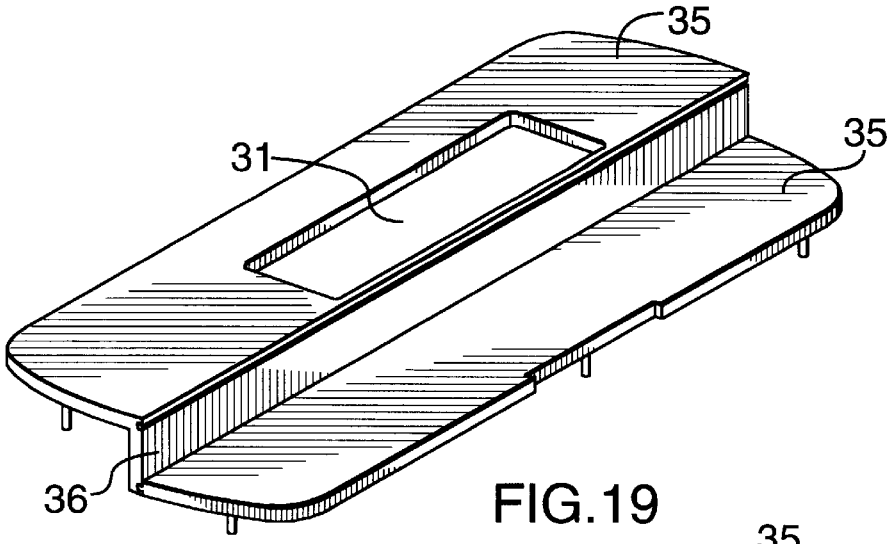
FIG. 19 is a perspective view of a two-tiered arrangement, where there are two panel sections at different levels.

FIG. 19 is a perspective view of a two-tiered arrangement, where there are two panel sections 35 and 35' at different levels, with a vertical connector panel 36 between them.

Figure 20:
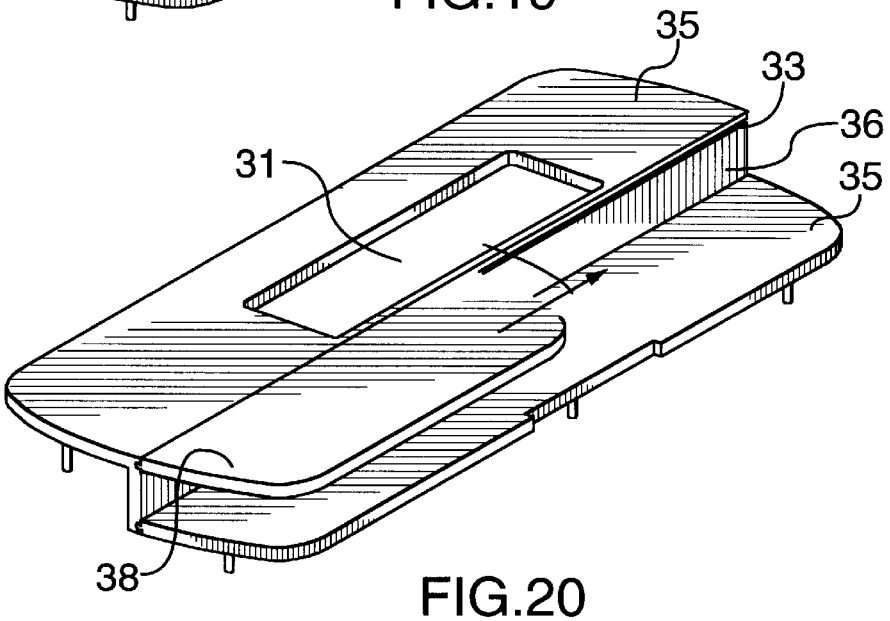
FIG. 20 is a view similar to FIG. 19, showing a third panel section which is movable along a track to selectively expose one portion or another of the panel section beneath it.
Figure 21:
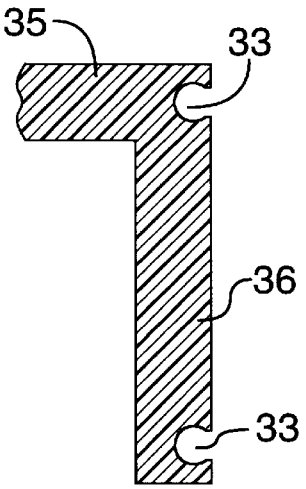
FIG. 21 is a cross-section of one version of FIG. 20, where a vertical connector panel is in one piece with the upper of the two panel sections.
Figure 22:
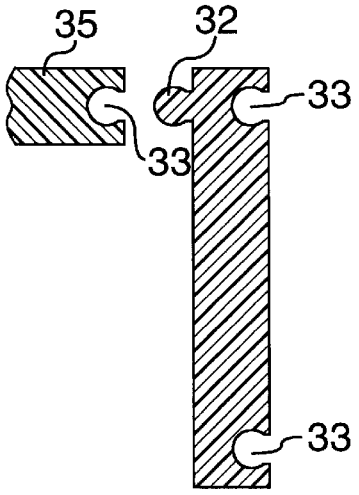
FIG. 22 is a cross-section of an alternative version of FIG. 20, where the vertical connector panel is a separate piece.

FIG. 20 is a view similar to FIG. 19, showing a third panel section 38 which is movable along a track such as the groove 33, to selectively expose one portion or another of the panel section 35' beneath it;

FIG. 21 is a cross-section of one version of FIG. 20, where the vertical connector panel 36 is in one piece with the upper of the two panel sections. FIG. 22 is a cross-section of an alternative version of FIG. 20, where the vertical connector panel 36 is a separate piece.

Figure 23:
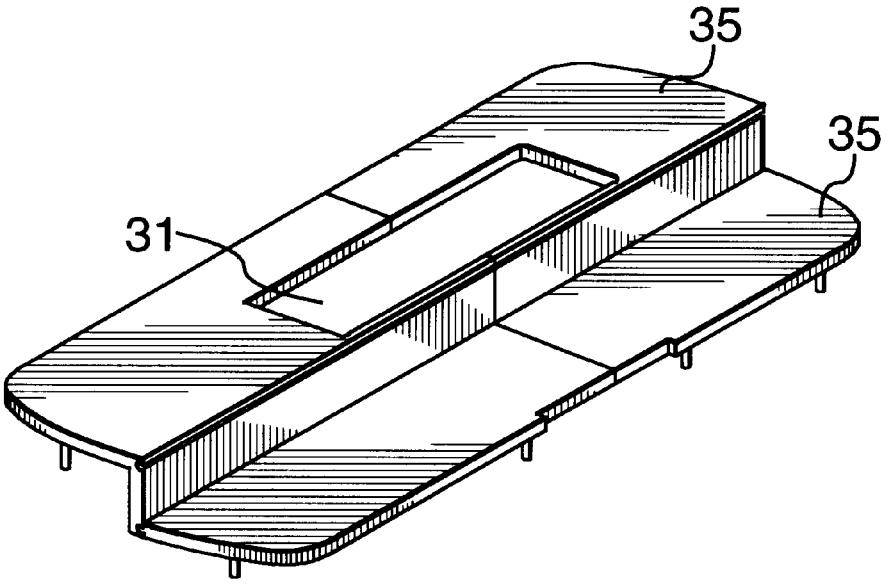
FIGS. 23–26 are perspective views of further alternative panel section configurations.
Figure 24:
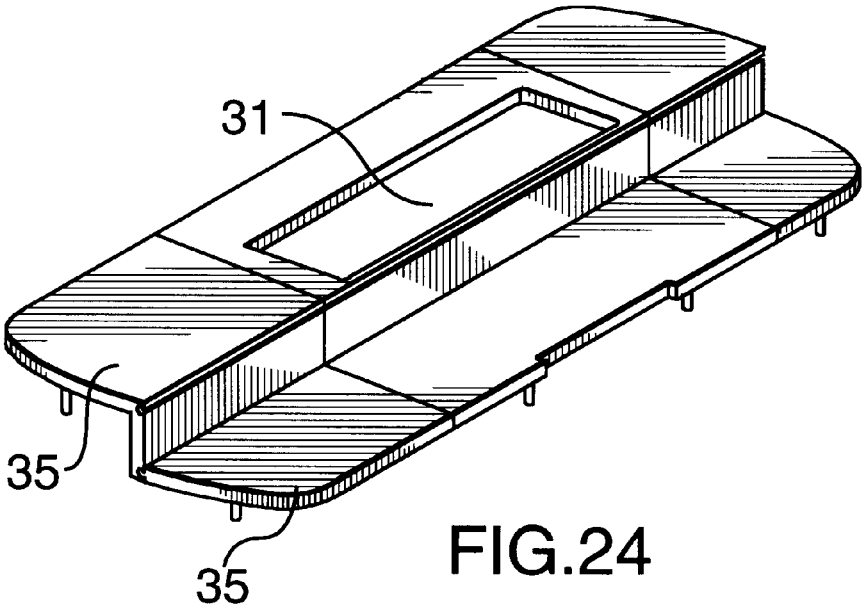
Figure 25:
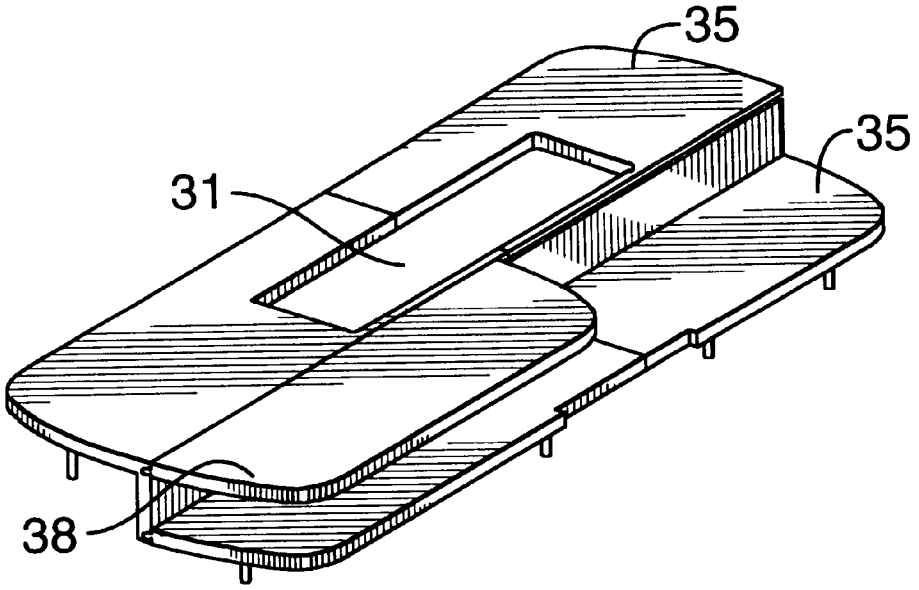
Figure 26:
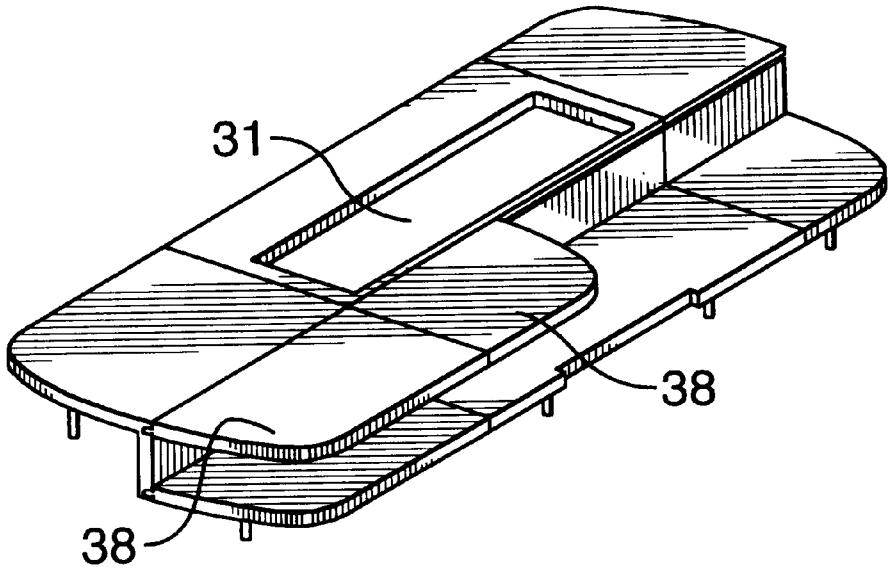

FIGS. 23–26 are perspective views of further alternative panel section configurations. In FIG. 23, the upper and lower panel sections 35 and 35' are each divided into two sections, i.e. there are in effect four separate panel sections. In FIG. 24, the upper and lower panel sections 35 and 35' are each divided into three sections, i.e. there are six separate panel sections. In FIG. 25, the upper and lower panel sections 35 and 35' are each divided into two sections, and there is a sliding panel section 38, i.e. there are five separate panel sections. In FIG. 26, the upper and lower panel sections 35 and 35' are each divided into three sections, and there are two complementary sliding panel sections 38 and 38', i.e. there eight separate panel sections.

Figure 27:
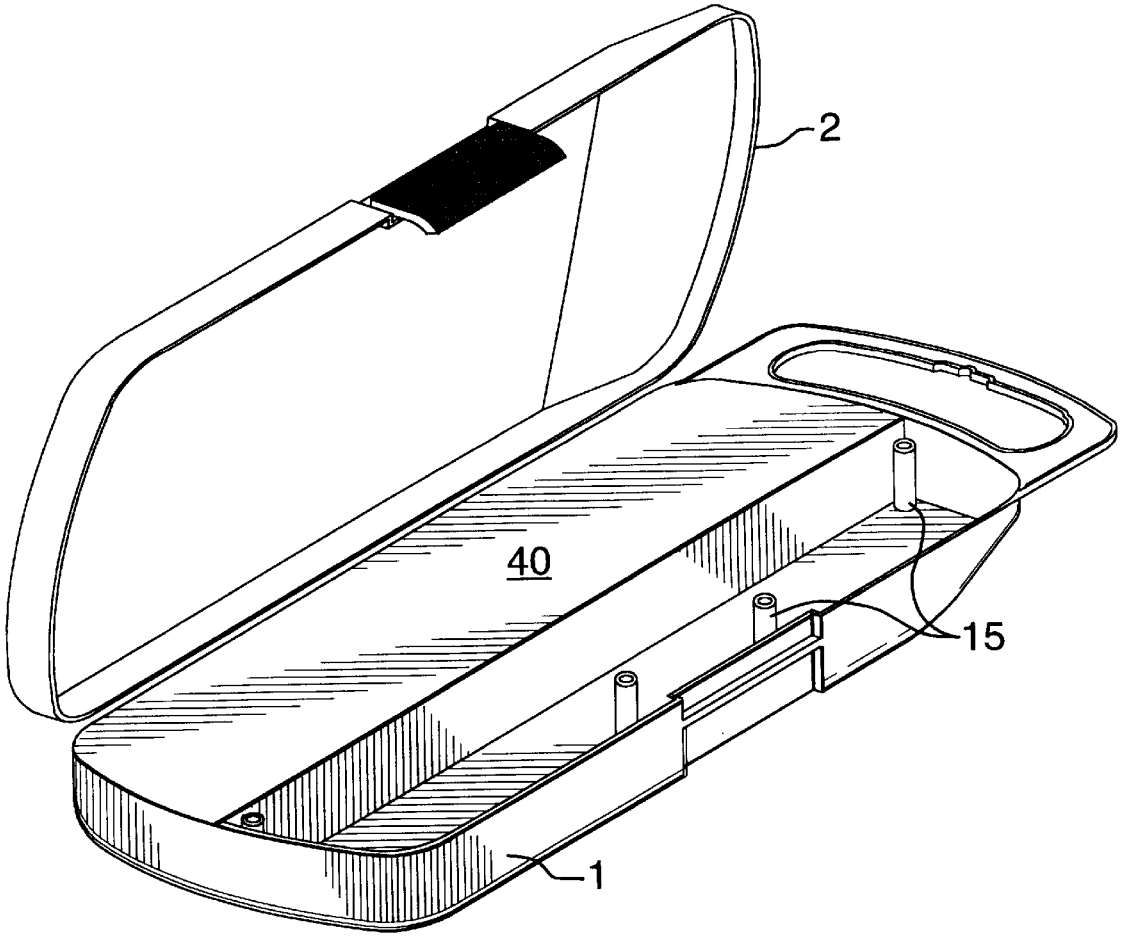
FIG. 27 is a perspective view of another embodiment of the invention where the base of the tool case has an elevated molded storage compartment and an empty portion that can accept panel sections.

FIG. 27 is a perspective view of an alternative base, with a portion 40 thereof being an elevated molded storage compartment. In this embodiment, the storage compartment extends the length of the base and an empty portion of the base adjacent to the storage compartment receives panel sections (not shown, but in a similar fashion as discussed above) to complete the surface. The top surface of the panel sections may be flush or stepped with the top surface of the compartment. The top surface of the compartment may be adapted (not shown) to receive tools while additional tools may be stored within the compartment.

Obviously these are examples only, and many other similar configurations are possible. It will thus be appreciated that the above description relates to the preferred embodiments by way of example only. Many variations on the invention will be obvious to those knowledgeable in the field, and such obvious variations are within the scope of the invention as described and claimed, whether or not expressly described.

What is claimed as the invention is:

1. A tool case comprising:

a box portion having an open top;

a lid securable onto said box portion;

a plurality of panel sections cooperatively configured to fit across the otherwise open top of said box portion, said panel sections having means for accommodating articles.

2. A case as recited in claim 1, where said panel sections each have at least one post projecting downwardly from bottom surfaces thereof, configured to fit into corresponding openings in posts extending upwardly from the bottom surface of said box portion.

3. A case as recited in claim 1, where said panel sections are secured to each other.

4. A case as recited in claim 3, where said panel sections are secured to each other by means comprising:

a male dovetail tab extending outwardly from at least one edge of one said panel section; and a female dovetail recess defined within at least one edge of another said panel section, positioned and configured to receive said male dovetail tab.

5. A case as recited in claim 1, where one of said panel sections has a handle portion extending therefrom and extending outside said box portion.

6. A case as recited in claim 1, where there are two said panel sections, secured to each other by:

a male dovetail tab extending outwardly from at least one edge of a first said panel section; and a female dovetail recess defined within at least one edge of a second said panel section, said side of a second panel section being adjacent to said side of said first panel section, said female dovetail recess being adapted to receive said male dovetail tab, said panel sections securable to the box portion by:

a molded plastic catch projecting downwardly from at least one edge of at least one of said panel sections:

a ridge projecting from at least one edge of said box portion adapted to retain said catch;

at least one post projecting downwardly from the bottom surface of said panel sections; and a plurality of corresponding openings extending upwardly from the bottom surface of said box portion, said openings adapted to receive said at least one post protruding from said plurality of panel sections.

7. A case as recited in claim 1, where the bottom surface of said box portion is recessed to define a storage compartment, said storage compartment being accessed from the underside of said box portion.

8. A case as recited in claim 7, where said storage compartment projects upwardly at least as far as the position of at least one of said panel sections, said at least one panel sections being provided with a corresponding aperture for said storage compartment.

9. A case as recited in claim 1, where there are more than two of said panel sections.

10. A case as recited in claim 3, where said panel sections are secured to each other by a tongue portion extending along an edge of one said panel section, engaging in a corresponding groove portion extending along an edge of another said panel section.

11. A case as recited in claim 1, where there are at least two panel sections at different levels relative to each other.

12. A case as recited in claim 11, where said panel sections at different levels are connected to each other.

13. A case as recited in claim 12, where said connection to each other is via a generally vertical connector panel.

14. A case as recited in claim 12, where a lower one of said panel sections has above it at least one smaller panel section which is slidably mounted relative thereto.

15. A case as recited in claim 14, where said slidable mounting is along an edge of an upper one of said panel sections.

16. A case as recited in claim 14, where said slidable mounting is along an upper portion of said generally vertical connector panel.

17. A case as recited in claim 1, where at least one of said panel sections is hinged to said box portion of said case.

18. A case as recited in claim 17, where storage space is provided beneath at least one said panel section hinged to said box portion.

19. A case as recited in claim 17, where there are two said panel sections hinged to said box portion adjacent opposite edges of said box portion, so as to fold down towards each other.

20. A case as recited in claim 1, where said panel sections are mounted in inward-facing grooves in walls of said box portion.

* * * * *